United States Patent [19]

Sakai et al.

[11] Patent Number: 4,521,502

[45] Date of Patent: Jun. 4, 1985

[54] COLOR RECORDING METHOD

[75] Inventors: Katsuo Sakai; Hiromi Demizu, both of Yokohama, Japan

[73] Assignee: Ricoh Company, Ltd., Tokyo, Japan

[21] Appl. No.: 450,375

[22] Filed: Dec. 16, 1982

[30] Foreign Application Priority Data

Dec. 28, 1981 [JP] Japan ..... 56-211026

[51] Int. Cl.[3] ..... G03G 13/01

[52] U.S. Cl. ..... 430/42; 355/3 R; 355/4; 430/48; 430/55; 430/102

[58] Field of Search ..... 355/3 R, 4; 430/42, 430/48, 51, 55, 102, 126

[56] References Cited

U.S. PATENT DOCUMENTS

| | | | |
|---|---|---|---|
| 2,899,335 | 8/1959 | Straughan | 430/126 X |
| 2,924,519 | 2/1960 | Bertelsen | 430/126 X |
| 2,940,847 | 6/1960 | Kaprelian | 355/4 X |
| 4,007,044 | 2/1977 | Shiga | 355/4 X |
| 4,207,101 | 6/1980 | Vola et al. | 430/126 |
| 4,294,902 | 10/1981 | Takashima et al. | 430/126 X |

*Primary Examiner*—Fred L. Braun

*Attorney, Agent, or Firm*—Oblon, Fisher, Spivak, McClelland and Maier

[57] ABSTRACT

A color recording method wherein equal amounts of photoconductive toner particles of three primary colors are uniformly mixed and applied as a layer on a doner member. Optical color images are projected onto this layer, thereby selectively decreasing the resistivities of the toner particles in patterns corresponding to the optical color images. Simultaneously or immediately thereafter there is applied a voltage thereacross, thereby selectively injecting charge into the photoconductive toner particles with decreased electric resistivities to form a charge distribution in the mixed toner layer corresponding to the projected optical color images. Using the charge distribution formed in the mixed toner layer, color recording is then performed by transferring the toner particles to a recording sheet in accordance with the charge distribution.

6 Claims, 4 Drawing Figures

T
I

WHITE
RED
GREEN
BLUE
BLACK
O
4
T
E2
I 5
51
52
T
E3
T
I

COLOR RECORDING METHOD

BACKGROUND OF THE INVENTION

The present invention relates to a color recording method for recording images in color by use of three types of translucent photoconductive toner particles in three primary colors, that is, for example, cyan, magenta and yellow, which toner particles are formed in a layer on a doner member, wherein the toner particles are electrically charged to a predetermined polarity, are exposed to optical color images which serve to selectively decrease the resistivities of the toner particles in patterns corresponding to the optical color images, are subjected to selective charge injection into the toner particles with decreased resistivities, resulting in formation of charge patterns in the layer corresponding to the optical images, and are transferred in the image patterns to a recording medium in accordance with the charge patterns.

Conventionally, as a method of recording images in color, a color recording method employing the Carlson electrophotographic process is well known.

The Carlson color recording method is unquestionably an excellent method, except for the twin shortcomings that a relatively long recording time is required, and a large-size apparatus is necessary, in order to separate the colors of an original image into three primary colors and to perform the electrophotographic copying process for reproduction of those primary colors.

Recently, so-called one-shot-full-color recording systems have been developed, which are capable of yielding recorded images in color by a single image exposure. In these recording systems, a photo-electrophoretic method and a particle color separation method are particularly well known. The photo-electrophoretic method is described, for instance, in U.S. Pat. No. 3,553,093 and U.S. Pat. No. 3,383,993, and the particle color separation method is described, for instance, in U.S. Pat. Nos. 4,294,902, 4,284,696, 4,262,078, 4,238,562, 4,230,784 and U.K. Pat. No. 2002913B.

The photo-electrophoretic method utilizes electrophoresis of photoconductive toner particles. More particularly, in the photo-electrophoretic method, three types of photoconductive toner particles in three primary colors are charged to a predetermined polarity, for instance, to a negative polarity, and are dispersed in an electrically insulating liquid medium. A pair of electrodes are placed in this dispersion in such a mode as to subject the toner particles to electrophoresis. One of the pair of electrodes is a transparent electrode charged, for instance, to a positive potential, while the other electrode is negatively charged and has an electrically insulating layer on the surface thereof.

Since the photoconductive toner particles are charged to a negative polarity, they are deposited uniformly on the surface of the transparent positive electrode. When an optical color image is projected on the back side of the transparent electrode, the photoconductive toner particles absorb the light of the optical image and become electrically conductive, with a decrease in the electric resistivities thereof by the light absorption, followed by positive charge injection into those toner particles from the transparent positive electrode, with those toner particles becoming charged to a positive polarity. Since voltage is applied between the two electrodes, the thus positively charged toner particles electrophoretically migrate towards the negative electrode.

As a result of the above-described projection of the optical color image onto the transparent positive electrode, a color image, either in a positive form or a negative form, corresponding to the optical color image, is formed by the toner particles remaining on the transparent positive electrode. The thus formed color image is transferred from the transparent electrode to an image transfer medium, whereby a color image is recorded.

In the particle color separation method, three types of transparent particles in three primary colors, for example, red particles, green particles and blue particles, are uniformly mixed. This mixture is coated in the form of a layer on the surface of a photoconductor. Optical color images are projected onto the photoconductor through the particle layer. Each colored particle contains a sublimational leuco dye which can be colored to the complementary color of the color of that particle. Further, each particle is electrically charged, for example, to a negative polarity and is deposited in the form of a layer on the surface of the photoconductor, which is electrically charged, for example, to a positive polarity.

Under the above-described conditions, optical color images are projected to the particle layer on the photoconductor. When an original contains, for instance, three image areas, a black image area, a white background and a red image area, no light is projected from the black image area onto the layer of the mixed particles, so that the mixture of the particles, that is, red, green and blue, remains in the area corresponding to the black image area on the photoconductor. Thus, the area of the layer of mixed particles on the photoconductor corresponding to the black image area is black in color.

In the area of the layer of mixed particles on the photoconductor corresponding to the white background, light passes through all the particles and reaches the photoconductor. As a result, the portion of the photoconductor where the light of the optical images passes through all the toner particles becomes electrically conductive and electric charges dissipate therefrom, so that the particles in the portion are no longer electrically attracted to the surface of the photoconductor. The particles which are no longer attracted to the photoconductor can be physically removed, for instance, by causing air to blow against the layer of the toner particles, resulting in a plain, i.e., white, background.

In the area of the layer of mixed particles on the photoconductor corresponding to the red image area, the red particles allow the light of the red image to pass therethrough, so that the light which passes through the red particles reaches the photoconductor. As a result, electric charges which attract the red particles to the photoconductor dissipate, and the red particles are no longer attracted to the photoconductor and can be physically removed. The green particles and blue particles remain attracted to the photoconductor.

A sheet of bottom paper for pressure-sensitive copying paper, which is coated, for example, with terra abla, and which serves as a recording sheet, is superimposed on the green and blue particles remaining on the photoconductor and heat is applied to the back side of the bottom paper, so that the leuco dyes contained in those particles are caused to sublime, with formation of a magenta dye from the green particles and yellow dye from the blue particles. The combination of the magenta dye and the yellow dye produces red color. The combination of the magenta dye, yellow dye and cyan dye produces black color in the case of the black image as discussed above.

By the above-mentioned color separation process, followed by the sublimation of the particles to produce their complementary colors, the black image, the plain area and the red image, respectively corresponding to the black image area, the plain background and the red image area of the original, are formed and transferred to the bottom paper which serves as a recording sheet.

With respect to other colors, the above-described color separation mechanism functions similarly.

Thus, the optical color images are subjected to color separation by the three types of transparent particles in the three primary colors contained in the particle layer, and the corresponding color images are recorded on the recording sheet.

The previously described electrophoretic color recording method is theoretically an excellent method. However, it is difficult to embody that method in a commercially acceptable apparatus, since the use of a liquid medium is indispensable.

On the other hand, in the case of the particle color separation method, plain paper cannot be used as the recording medium; rather, it is necessary to use a coated sheet of bottom paper for pressure-sensitive copying paper. Furthermore, as the particle size of the particles employed in that method decreases, appreciable fogging is apt to occur.

Finally, the above-described two methods have the shortcoming that they do not yield high color image density, because there is substantially no overlapping of the photoconductive toner particles and no overlapping of the colored image areas.

SUMMARY OF THE INVENTION

It is therefore an object of the present invention to provide a color recording method of a one-shot type, which is capable of eliminating the above discussed shortcomings of the conventional color recording methods.

The color recording method according to the present invention comprises the steps of: mixing uniformly three types of photoconductive toner particles in three primary colors, that is, for example, cyan, magenta and yellow, each type being in an equal amount; forming a layer of the uniformly mixed three types of photoconductive toner particles on a doner member; projecting optical color images onto the layer of photoconductive toner particles, thereby selectively decreasing the resistivities of the toner particles in patterns corresponding to the optical color images; applying voltage across the layer of the photoconductive toner particles in the direction of the thickness thereof simultaneously with or immediately after the projection of the optical color images, thereby performing charge injection selectively into the photoconductive toner particles with decreased electric resistivities, and thereby forming a charge distribution in the mixed toner layer corresponding to the projected optical color images; and performing color recording by use of the charge distribution formed in the mixed toner layer, for instance, by transferring the toner particles to a recording sheet in accordance with the charge distribution.

DETAILED DESCRIPTION OF THE PREFERRED EMBODIMENTS

Figure 1:
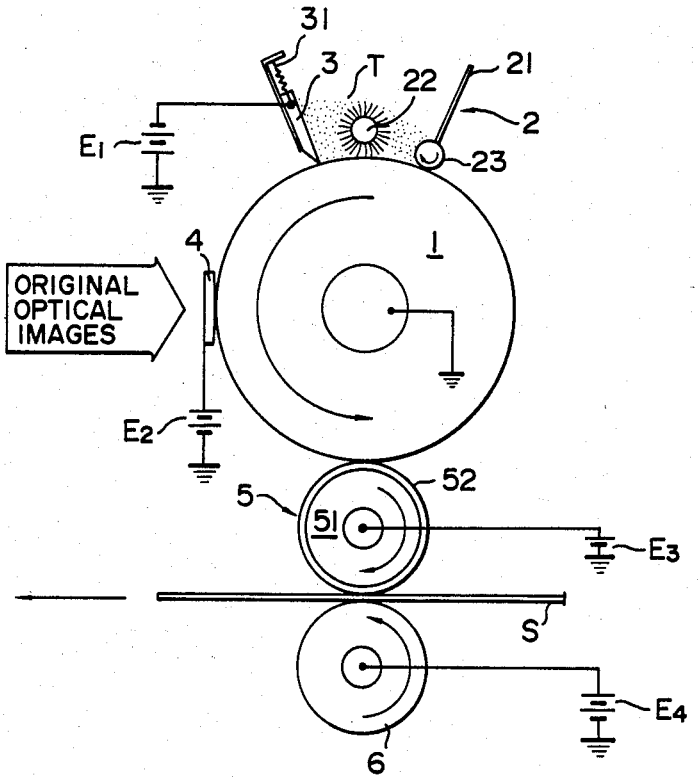
FIG. 1 is a schematic illustration of a color recording apparatus in which a color recording method according to the present invention is employed.

In the present invention, three types of translucent photoconductive toner particles with three primary colors, that is, for example, cyan, magenta and yellow, are employed.

These three types of photoconductive toner particles in those three primary colors are uniformly mixed, with each type being in an equal amount. A layer of the mixture of the photoconductive toner particles is formed on a doner member. Optical color images are projected onto the layer of photoconductive toner particles. Voltage is applied across the layer of the photoconductive toner particles in the direction of the thickness thereof simultaneously with or immediately after the projection of the optical color images, whereby selective charge injection is performed into the photoconductive toner particles whose resistivities have been decreased by the projection of the optical color images, and a charge distribution corresponding to the projected optical color images is formed in the mixed toner layer. In the above, the phrase "immediately after" means during a period in which the photoconductive toner particles which were made electrically conductive by the projection of optical color images thereto still maintain their relatively low resistivities, at which resistivities, for instance, positive charge injection is possible.

The charge distribution thus formed in the mixed toner layer is employed for recording color images. More specifically, the charge-injected toner particles distributed in accordance with the selective charge injection are transferred to a recording medium.

Alternatively, the charge-injected toner particles are caused to remain on the doner member, while the other toner particles which were not subjected to charge injection are transferred to a recording medium.

In the present invention, color image exposure can be performed by any of the conventional methods, such as by projection of the optical color images of an original, by optical line-scanning with three-color laser beams, or by exposure using an LED array.

In the present invention, charge injection is performed into the mixture of toner particles with different electric resistivities, some being high and others extremely low.

In connection with such charge injection, some of the experimental facts which are utilized in the present invention are described in a copending U.S. patent application Ser. No. 102,832, filed on Dec. 12, 1979, now U.S. Pat. No. 4,446,471, which discloses an invention relating to a recording method named LIST (Latent Image Injecting to Surface of Toner).

The LIST recording method comprises the steps of forming a layer of toner particles on a doner member, performing charge injection by a multi-stylus electrode to the surface of the layer of toner particles in accordance with a recording pattern to form a charge-injected toner particle pattern corresponding to the recording pattern, and converting the charge-injected toner particle pattern to a visible form.

Concerning the LIST recording method, a variety of basic experiments have been conducted, and certain basic experimental facts relating to the present invention are as follows:

When a visible image pattern is formed by the steps of bringing an electrode into contact with the surface of the layer of toner particles on the doner member to perform charge injection into the layer of toner particles, and transferring the charge-injected toner particles to a recording medium to form a visible image pattern, the image density of the visible image pattern is proportional to the amount of electric charges injected into a unit weight of the toner particles.

The amount of electric charges injected to a unit weight of toner particles is proportional to the period of application of voltage to the electrode which is in contact with the toner layer. By this charge injection, the toner is electrically charged to the same polarity as that of the applied voltage.

The charging rate of the toner particles by the charge injection increases as the resistivity of the toner particles decreases. In other words, the greater the resistivity of the toner particles, the longer the time required for electrically charging the toner particles.

Based on the above described experimental observations, the following experiment by use of a LIST recording apparatus was conducted:

In this experiment, a mixture of a black toner with a resistivity of approximately $10^{11}$ Ωcm and a red toner with a resistivity of approximately $10^{13}$ Ωcm was employed.

By use of a doctor blade which served as a charge-injection electrode as well, a layer of the mixed toner was formed on a doner member, under application of a negative voltage to the mixed toner through the doctor blade, whereby the layer of the mixed toner was uniformly charged to a negative polarity.

A multi-stylus electrode was brought into contact with the layer of the mixed toner, and pattern signals with a positive polarity were applied to the layer of the mixed toner, for the formation of an image pattern, through the multi-stylus electrode. The toner particles charged to a positive polarity were selectively transferred from the doner member to a sheet of plain paper under application of voltage with a negative polarity.

In this experiment, the moving speed of the layer of the mixed toner on the doner member relative to the multi-stylus electrode was 50 mm/sec, and the period of time for application of the charge pattern signals to the multi-stylus electrode was 0.25 msec per picture element. The result was a visible image pattern made of nearly 100% black toner and having high image density.

The fact that a visible image pattern substantially made of the black toner only was obtained indicated that charge injection by the multi-stylus electrode was selectively performed into the black toner with low resistivity.

The above-described experiment was repeated during the course of development of the present invention and the above-described experimental results were confirmed to be correct. In addition to those experimental results, experiments conducted for the present invention indicated that (i) positive charge injection into the black toner was performed uniformly throughout the layer of the mixed toner in the thickness direction thereof (the thickness of the layer was in the range of 20 μm to 30 μm), as evidenced by the extremely high image density obtained, and (ii) almost all the positively charged black toner was transferred to the recording medium.

The present invention is based upon the above-described experimental results.

Referring to FIG. 1, an embodiment of a color recording method according to the present invention will now be explained. That figure is a schematic illustration of a recording apparatus in which an embodiment of a color recording method according to the present invention is employed.

In the figure, reference numeral 1 indicates a doner member; reference numeral 2, a hopper; reference numeral 3, a doctor blade for forming a layer of toner on the doner member 1, which doctor blade 3 serves as a charge-injection electrode as well; reference numeral 4, a transparent electrode; reference numeral 5, an intermediate image transfer roller; and reference numeral 6, an image transfer roller.

As shown in the figure, the doner member 1 is in the shape of a roller, grounded and rotatable in the direction of the arrow, which doner member 1 is of the same type as that employed in the LIST recording method.

The hopper 2 comprises a body member 21, a stirrer 22 and a roller 23. The hopper 2 is disposed above the doner member 1, holding a mixed toner T therein. The mixed toner is supplied to the surface of the doner member 1 from a toner supply outlet of the hopper 2, directed towards the upper surface of the doner member 1.

The doctor blade 3 is disposed at the upper left side of the doner member 1 through a side wall portion (not shown), in such a manner as to extend in the direction parallel to the axis of the doner member 1, in pressure contact with the peripheral surface of the doner member 1 by a pressure application means 31. Further, the doctor blade 3 is connected to a power source E1.

The transparent electrode 4 is disposed at a color image exposure section of this recording apparatus in such a manner as to extend in the direction parallel to the axis of the doner member 1, in contact with the peripheral surface of the doner member 1. Further, the transparent electrode 4 is connected to a power source E2. Color image exposure is performed through the transparent electrode 4.

As an optical system for this color image exposure, a slit exposure optical system for a conventional copying machine is employed. The slit width for the slit exposure optical system is set at 5 mm in this particular apparatus.

The intermediate image transfer roller 5 comprises a metallic roller 51 and an electrically insulating layer 52 formed on the peripheral surface of the metallic roller 51. The intermediate image transfer roller 5 is in contact with the doner member 1 in such a manner that a lower peripheral surface portion of the doner member 1 extending in the axial direction thereof is in contact with an upper peripheral surface portion of the intermediate image transfer roller 5 extending in the axial direction thereof. The metallic roller 51 is connected to a power source E3.

The image transfer roller 6 is a metallic roller and is disposed in parallel with and in association with the intermediate image transfer roller 5 in such a manner that a recording sheet S can be transported in the direction of the arrow between the two rollers 5 and 6. The image transfer roller 6 is connected to a power source E4.

The process of the color recording method by use of the above-described color recording apparatus will now be explained.

The mixed toner T comprises three types of photoconductive toner particles mixed uniformly. The toner particles of each type are translucent and are colored in one of three primary colors, that is, for example, magenta, cyan and yellow.

A cyan toner which is made electrically conductive when exposed to red light can be prepared, for example, by dispersing polystyrene, zinc oxide powder and methylene blue in toluene until the polystyrene and the methylene blue are dissolved in the toluene, followed by subjecting the dispersion to a conventional spray-and-dry process to form cyan toner particles with a particle size ranging from 10 μm to 20 μm.

A magenta toner which is made electrically conductive when exposed to green light can be prepared, for example, by dispersing polystyrene, zinc oxide and Rose Bengal in toluene, followed by subjecting the dispersion to the spray-and-dry process in the same manner as in the preparation of the above-described cyan toner. It is preferable that the particle size of the magneta toner be also in the range of 10 μm to 20 μm.

A yellow toner which is made electrically conductive when exposed to blue light can be prepared, for example, by dispersing polystyrene, zinc oxide and merocyanine in toluene, followed by subjecting the dispersion to the spray-and-dry process in the same manner as in the preparation of the above-described cyan toner. It is preferable that the particle size of the magneta toner be also in the range of 10 μm to 20 μm.

In the above-described three types of toners, it is extremely difficult to make the particle size uniform in the range less than 10 μm. On the other hand, when the particle size exceeds 20 μm, it is difficult to produce sharp images.

When the doner member 1 is driven in rotation in the direction of the arrow, the mixed toner T is supplied onto the peripheral surface of the doner member 1 and is formed into a layer by the doctor blade 3. It is preferable that the thickness of the layer of the mixed toner be in the range of 20 μm to 30 μm. When the thickness is less than 20 μm, images with high image density cannot be obtained, while, when the the thickness exceeds 30 μm, toner deposition on the background tends to occur considerably.

The doctor blade 3 is connected to a power source E1 and serves as an electrode through which electric charges are injected into the mixed toner T, with a charging potential, negative or positive, ranging from 50 V to 400 V, when the mixed toner T is transported under the doctor blade 3. By that charge injection, the layer of the mixed toner formed on the doner member 1 is uniformly charged, for example, to a negative polarity.

Figures 2A, 2B, 2C:
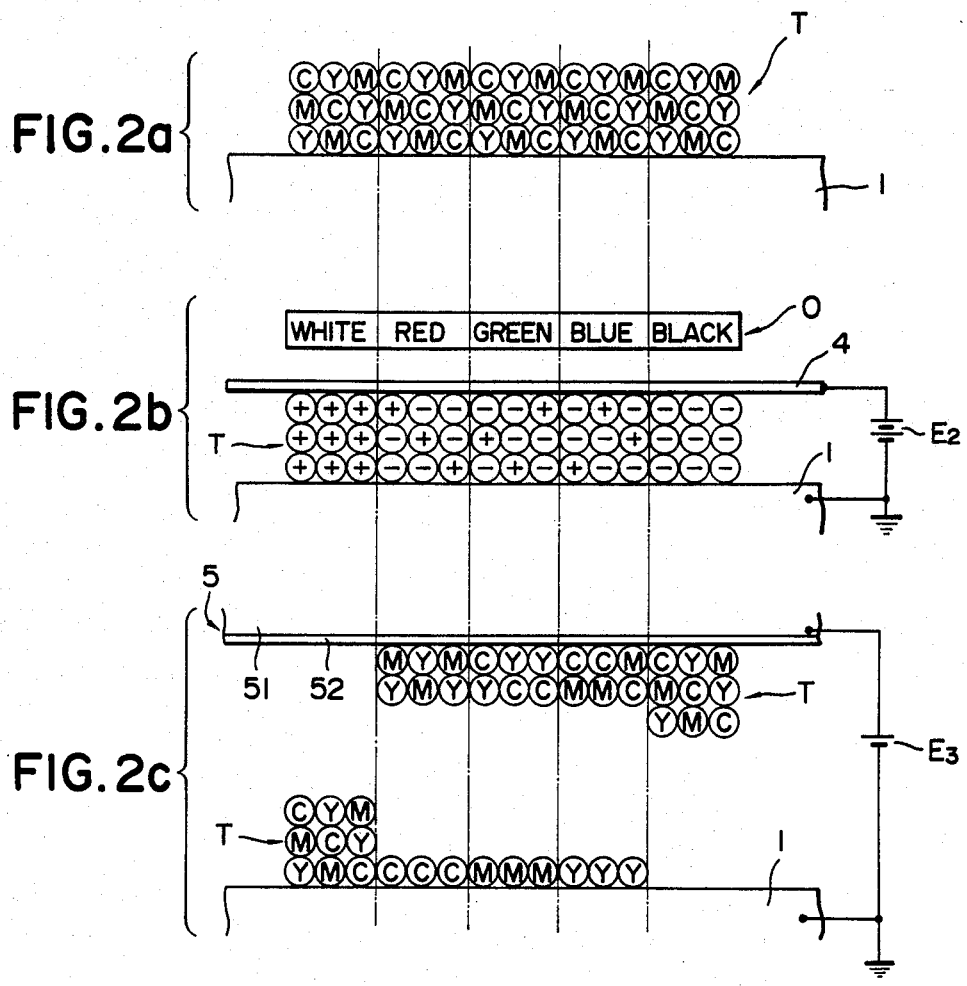
FIGS. 2*a* through 2*c* are illustrations in explanation of the process of the color recording method according to the present invention.

Referring to FIG. 2*a*, there is schematically shown the structure of the layer of the mixed toner T formed on the doner member 1. In the figure, symbols C, Y and M respectively indicate the colors of the toner particles, cyan, yellow and magenta.

When the layer of the mixed toner T comes under the transparent electrode 4 with further rotation of the doner member 1, an optical color image is projected through the transparent electrode 4 onto the layer of the mixed toner T by the slit exposure system (not shown), so that color image exposure is carried out.

As illustrated in FIG. 2*b*, if an original O contains a red image area, a green image area, a blue image area and a black image area with a white background, red light, green light and blue light are projected onto the layer of the mixed toner T, respectively corresponding to the red image area, the green image area and the blue image area, while, onto the portion of the layer of the mixed toner T corresponding to the black image area, no light is projected, and, onto the portion of the layer of the mixed toner T corresponding to the white background, white light is projected.

As can be seen from FIG. 2*b*, the arrangement of the mixed toner particles in the layer is exactly the same as that of the toner particles shown in FIG. 2*a*.

In the area of the toner layer corresponding to the background of the original O, all the toner particles are made electrically conductive, with decreased electric resistivity by the white light projected thereto.

To the transparent electrode 4 which is in contact with the layer of the mixed toner on the doner member 1, a potential ranging from +50 V to +500 V is applied.

As a result, positive charges are injected into the toner particles in that area from the transparent electrode 4, and those toner particles become positively charged. When the voltage applied to the transparent electrode 4 is less than +50 V, charging injection is difficult, while, when that voltage exceeds +500 V, discharging takes place by which normal charge injection is hindered.

In contrast to this, in the area of the toner layer corresponding to the black image area of the original O, no light is projected onto the toner particles with the result that those particles remain negatively charged.

In the area of the toner layer corresponding to the red image area of the original O, red light is projected onto the toner particles and only the photoconductive toner particles C, in the color cyan, absorb the red light, so that only the toner particles C become electrically conductive and positive charges are injected thereto.

Likewise, in the area of the toner layer corresponding to the green image area of the original O, positive charges are injected only into the magenta toner particles M which are made electrically conductive by absorption of the green light from the green image area. Further, in the area of the toner layer corresponding to the blue image area of the original O, positive charges are injected only into the yellow toner particles Y which are made electrically conductive by absorption of the blue light from the blue image area.

Thus, an electric charge distribution corresponding to the color images of the original is formed in the layer of the mixed toner particles as illustrated in FIG. 2*b*.

With further rotation of the doner member 1, the layer of the mixed toner with the above-described electric charge distribution is transported between the doner member 1 and the intermediate image transfer roller 5. Since a positive voltage for image transfer is applied to the intermediate image transfer roller 5 by a power source E3, the toner particles which have been charged to a negative polarity are transferred from the doner member 1 to the intermediate image transfer roller 5. This state is illustrated in FIG. 2*c*.

In this color recording method, only the photoconductive toner particles which have not been subjected to positive charge injection are transferred to the intermediate image transfer roller 5, so that visible color images are formed on the intermediate image transfer roller 5. More specifically, on the surface of the intermediate image transfer roller 5 in the area corresponding to the black image area, the combination of the cyan toner particles, the magenta toner particles and the yellow toner particles produces a black color; in the area corresponding to the red image area, the combination of the magenta toner particles and the yellow toner particles produces a red color; in the area corresponding to the green image area, the combination of the cyan toner particles and the yellow toner particles produces a green color; and the area corresponding to the blue image area, the combination of the cyan toner particles and the magenta toner particles produces a blue color.

The thus formed visible color images are transferred from the intermediate image transfer roller 5 to a recording sheet S by the image transfer roller 6.

The color images are then permanently fixed to the recording sheet S by an image fixing apparatus (not shown). In the meantime, the toner particles remaining on the surface of the intermediate image transfer roller 5 are removed therefrom by a cleaning apparatus (not shown).

Embodiments of a color recording method according to the present invention will now be explained by referring to the following specific examples:

Example 1

Cyan toner with an average particle size of 10 m was prepared by dispersing 100 g of polystyrene, 100 g of zinc oxide powder with an average particle size of 0.1 μm, and 0.1 g of methylene blue in toluene until the polystyrene and the methylene blue were dissolved in the toluene, and then by subjecting the dispersion to a spray-and-dry process.

Likewise, magenta toner with an average particle size of 10 μm was prepared by dispersing 100 g of polystyrene, 100 g of zinc oxide powder with an average particle size of 0.1 μm, and 0.1 g of Rose Bengal in toluene to the same extent as in the case of the cyan toner, and then by subjecting the dispersion to the above-mentioned spray-and-dry process.

Finally, yellow toner with an average particle size of 10 μm was prepared by dispersing 100 g of polystyrene, 100 g of zinc oxide power with an average particle size of 0.1 μm, and 0.1 of merocyanine in toluene to the same extent as in the case of the cyan toner, and then by subjecting the dispersion to the spray-and-dry process.

The thus prepared cyan toner particles, magenta toner particles and yellow toner particles were found to change their resistivities by an order of 10 Ωcm or more, for instance, from $10^{13}$ Ωcm or more in the dark to $10^{12}$ Ωcm or less in the light, when respectively exposed to red light, green light and blue light with an intensity of illumination ranging from 5 $\mu J/cm^2$ to 10 $\mu J/cm^2$. These three types of toner particles were mixed uniformly, with each type being equal in amount, to prepare a mixed toner T.

The color recording method according to the present invention was performed by use of the above-described mixed toner T in the color recording apparatus which is schematically illustrated in FIG. 1.

In this example, the voltages of the power sources E1, E2, E3 and E4 were respectively set at −100 V, +300 V, +50 V and +150 V.

The thickness of the layer of the mixed toner was approximately 25 μm, and the amount of electric charges in each type of toner particles on the doner member 1 at the time of the initial charging was in the range of −10 μC/g to −20 μC/g. The moving speed of the layer of the mixed toner on the doner member 1 was set at 50 mm/sec.

Under the above-described conditions, color image recording was performed onto a sheet of plain paper. The result was that there were obtained good colored images, with high image density, with a resolution of 6 to 7 lines/mm, without toner deposition on the background, and with relatively good color reproduction of the original color images.

When the moving speed of the layer of the mixed toner on the doner member 1 was increased to 100 mm/sec, the same good results were obtained as at 50 mm/sec of the toner layer moving speed.

Example 2

In this example, the same mixed toner as that employed in Example 1 was employed.

The polarities of the power sources E3 and E4 were respectively reversed to −50 V and −150 V, and optical color image exposure was performed by use of a negative of a normal original, so that only positive charge-injected toner particles were selectively transferred to a recording sheet of plain paper. As a result, excellent positive color images of the original were obtained.

In this case, the step of uniformly charging the toner particles to a negative polarity by the doctor blade 3 could have been omitted.

Example 3

Example 1 was repeated except that the transparent electrode 4 in the apparatus shown in FIG. 1 was removed, and instead an ordinary metallic electrode with a width of 5 mm was disposed in contact with the layer of the mixed toner at a position immediately downstream from the color image exposure section, so that charge injection into the positively charged toner particles was performed immediately after the optical color image exposure.

The results were as good as the results obtained in Example 1.

Example 4

Example 2 was repeated except that the transparent electrode 4 in the apparatus shown in FIG. 1 was removed, and instead an ordinary metallic electrode with a width of 5 mm was disposed in contact with the layer of the mixed toner at a position immediately downstream from the color image exposure section, so that charge injection into the positively charged toner particles was performed immediately after the optical color image exposure.

The results were as good as the results obtained in Example 2.

What is claimed is:

1. A color recording method for recording images in color, comprising the steps of:

forming a uniform mixture of three types of translucent photoconductive toner particles in three primary colors in a hopper which holds said toner particles therein;

supplying said mixed toner particles from said hopper onto a doner member which is an electrically conductive doner roller;

forming a layer having a predetermined thickness of said uniform mixture of three types of translucent photoconductive toner particles on said doner member by a doctor blade means while applying a predetermined voltage of a first polarity to said layer of said toner particles through said doctor blade means;

subjecting the layer of the mixture of said photoconductive toner particles to a color image exposure, thereby selectively decreasing the electric resistivities of said toner particles in patterns corresponding to the color image exposure;

applying a predetermined voltage of a second polarity opposite to the first polarity across the layer of said photoconductive toner particles in the direction of thickness thereof during a period in which said photoconductive toner particles which have been made electrically conductive by the color image exposure thereto still maintain their decreased resistivities, at which resistivities charge injection into said photoconductive toner particles with decreased electric resistivities is possible, thereby forming a charge distribution in the layer of said photoconductive toner particles corresponding to the color image exposure;

separating the layer of said photoconductive toner particles into a charge-injected portion and a non-charge-injected portion in accordance with charge distribution; and transferring said non-charge-injected portion onto a recording medium.

2. A color recording method as claimed in claim 2, wherein said translucent photoconductive toner particles comprise cyan toner particles, magenta toner particles and yellow toner particles, said cyan toner particles becoming electrically conductive by absorption of red light, said magenta toner particles becoming electrically conductive by absorption of green light, and said yellow toner particles becoming electrically conductive by absorption of blue light.

3. A color recording method as claimed in claim 1, wherein the particle size of the three types of said photoconductive toner particles is in the range of 10 μm to 20 μm.

4. A color recording method as claimed in claim 1, wherein the thickness of the layer of said photoconductive toner particles formed on said doner member is in the range of 20 μm to 30 μm.

5. A color recording method as claimed in claim 1, wherein the voltage applied to the layer of said photoconductive toner particles through said doctor blade means is in the range of −50 V to −400 V.

6. A color recording method as claimed in claim 1, wherein the voltage applied to the layer of said photoconductive toner particles after the color image exposure is in the range of +50 V to +500 V.

* * * * *